United States Patent [19]

Macisaac

[11] Patent Number: 4,968,086

[45] Date of Patent: Nov. 6, 1990

[54] CAMPER UNIT

[76] Inventor: Gerard C. Macisaac, 17 McCubbin Street, Burwood, Victoria, 3125, Australia

[21] Appl. No.: 299,807

[22] PCT Filed: Jul. 9, 1987

[86] PCT No.: PCT/AU87/00211

§ 371 Date: Mar. 9, 1989

§ 102(e) Date: Mar. 9, 1989

[87] PCT Pub. No.: WO88/00632

PCT Pub. Date: Jan. 28, 1988

[30] Foreign Application Priority Data

Jul. 11, 1986 [AU] Australia ..... PH6897/86

[51] Int. Cl.[5] ..... B60P 3/34

[52] U.S. Cl. ..... 296/160; 135/88

[58] Field of Search ..... 296/160; 135/88, 116, 135/102, 106, 109; 5/110, 111

[56] References Cited

U.S. PATENT DOCUMENTS

| | | | |
|---|---|---|---|
| 2,222,636 | 11/1940 | Strauss | 135/88 |
| 2,848,007 | 8/1958 | Churchill | 135/88 |
| 3,028,607 | 4/1962 | Tolf | 5/119 |
| 3,088,475 | 5/1963 | Muhr | 135/88 |
| 3,623,762 | 11/1970 | Fagan | 296/160 |
| 3,844,300 | 10/1974 | Sanders | 135/88 |
| 4,522,441 | 6/1985 | Allison | 296/160 |

FOREIGN PATENT DOCUMENTS

| | | |
|---|---|---|
| 1155573 | 10/1963 | Fed. Rep. of Germany . |
| 2282242 | 3/1976 | France . |
| 989081 | 4/1965 | United Kingdom . |
| 1454692 | 11/1976 | United Kingdom . |

*Primary Examiner*—Robert R. Song

*Attorney, Agent, or Firm*—Harness, Dickey & Pierce

[57] ABSTRACT

A camper unit for vehicle cabin roofs, comprising:

a support frame adapted to be secured to the cabin roof of a vehicle;

plural elongate members arranged together to define a bed base peripherally about a sleeping zone, wherein the bed base is detachably secured to the support frame;

a canopy assembly mounted to the bed base and adjustable between a compact collapsed condition and an expanded erect condition;

an elongate support extending centrally of the bed base and having an uppermost face just below the level of the bed base; and a bed base sheet secured to the bed base and being such that, when loaded with two sleepers in the sleeping zone, the bed base sheet sags sufficiently to contact said elongate support and to comfortably cradle the respective sleepers to opposite sides of the elongate support.

12 Claims, 3 Drawing Sheets

CAMPER UNIT

This invention relates to a camper unit particularly adapted for transport and use while atop a cabin roof of a vehicle yet not excluding its possible use off the vehicle.

Where it has been desired to provide a light, simple, low cost camper unit in which two sleeping adults are intended to be comfortably and securely supported, it has not been feasible to use the flexible surface stretcher concept so acceptable for single bed applications.

There is a requirement that a pair of sleepers on a common vehicle roof mounted camper surface experience no resultant lateral forces (due to, e.g. gravitational influence, or non-horizontal application, or wind movements) that would either lead to rolling out over the side or to rolling centrally together. This state of inertia is essential to achieve the total confidence needed both mentally and physically for relaxation and sound sleep.

Need for a non-obtrusive, securing and separating cradling means is all the more vital in vehicle top applications, where height from the ground, a high likelihood the vehicle will not be exactly level, and inherent swaying movements have to be considered.

The conventional rigid co-planar bed base falls quite short of ideal for double bed vehicle top application even when a foam mattress of substantial thickness, bulk and cost is employed, which of course would be highly impractical in this application.

It is an object of the present invention to provide a camper unit, particularly for vehicle cabin roof application, of substantially simpler and more economical construction than all units to date offered, including that presented in U.S. Pat. No. 4,050,732 to the present applicant. It is a further object to provide such a camper unit capable of comfortably supporting two separate sleeping adults on its underlying bed base surface, whether used with or without a mattress.

The invention accordingly provides a camper unit for vehicle cabin roofs, comprising:

a support frame adapted to be secured to the cabin roof of a vehicle;

plural elongate members arranged together to define a bed base peripherally about a sleeping zone;

means for detachably securing said bed base to the support frame;

a canopy assembly mounted to said bed base and adjustable between a compact collapsed condition and an expanded erect condition;

an elongate support extending centrally of the bed base and having an uppermost face just below the level of the bed base; and bed base sheet means secured to the bed base and being such that, when loaded with two sleepers in said sleeping zone, said bed base sheet means sags sufficiently to contact said elongate support and to comfortably cradle the respective sleepers to opposite sides of said elongate support.

The resultant degree of "separate cradling" is not only acceptable and tolerable in roof top application but, as described and illustrated, is both needed and desirable. A sleeping surface condition is thus achieved that has, up until this time, been considered impossible and hence not available.

The support frame is conveniently comprised of a specialized pair of vehicle roof carry bars, each provided with devices for adjustable connection of the bars to the lateral gutter regions of a cabin roof. Typically in situ, the carry bars extend transversely above the roof and bracket assemblies are provided to mount the elongate support across and above the carry bars. Each of the bracket assemblies is adjustable both longitudinally of the respective carry bar and vertically with respect to the cabin roof.

In a typical arrangement, the bed base is generally rectangular, includes lateral and front and rear elongate bed base members, and is supported, say, 80 mm above the carry bars by means including pairs of upstanding brackets welded, bolted or otherwise secured to the carry bars and detachably attached to the lateral bed base members. The elongate support is conveniently secured to the carry bars by similarly attached single brackets, for example with its uppermost face immediately below, preferably up to 30 mm below, the lowermost plane of the lateral bed base members and midway between them.

The resultant maximum cradling sag of the bed base sheet between the elongate support and the lateral bed base members is such that the sheet does not contact the support frame when either one or two sleepers are in a relaxed horizontal mode. The minimum clearance is preferably 15 mm.

Permitting this degree of bed base sheet sag or cradling not only achieves a mentally and physically relaxed state conducive to safety and sleep but so reduces local weight stress forces on the bed base sheet material, its stitching and the total bed base and roof support system that these forces will be well within tolerable limits to permit normally available commercial material to be employed.

The canopy assembly typically comprises a plurality of hingedly mounted U-shaped ribs, and a canopy attached to the ribs and to the bed base. The canopy is preferably attached to each of said ribs by plural ties each having a clip which releasably snap engages a complementary aperture in the rib.

The invention also provides a camper unit for vehicle cabin roofs, comprising:

a support frame adapted to be secured to the cabin roof of a vehicle;

plural elongate members arranged together to define a bed base peripherally about a sleeping zone;

means for detachably securing said bed base to the support frame;

a canopy assembly mounted to said bed base and adjustable between a compact collapsed condition and an expanded erect condition;

an elongate support extending centrally of the bed base and mounted to sail support frame; and bed base sheet means secured to the bed base and being such that, when loaded with two sleepers in said sleeping zone, said bed base sheet means contacts said elongate support and sags to comfortably cradle the respective sleepers to opposite sides of said elongate support.

The invention will now be described, by way of example only, with reference to the accompanying drawings, in which.

Figure 1:
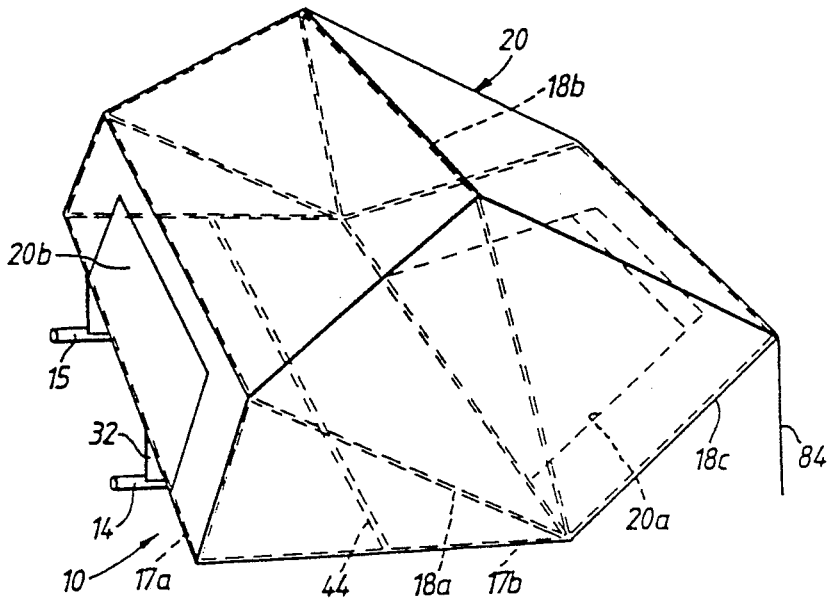
FIG. 1 is a purely schematic view showing the configuration of an expanded camper unit according to the invention.

The illustrated camper unit 10 is shown mounted atop the cabin roof 12 of a sedan vehicle. The camper unit includes a support frame comprising specialized carry bars 14, 15; lateral, front and rear tubular bed base tubes 17*a*, 17*b*; canopy ribs 18*a*, 18*b*, 18*c*; a canopy 20 of canvas or other suitable synthetic material; a travel cover 22 of appropriate heavy duty material; a bed base sheet 21; and a longitudually extending elongate support 44 for bed base sheet 21.

Carry bars 14, 15 are typically about 900 mm apart. They are fastened by respective adjustable clamp straps 24 to respective bracket assemblies 23 including depending curved elbow legs 26. Legs 26 are in turn secured to heavy duty conventional adjustable feet 28 for securing bars 14, 15 via legs 26 to the lateral gutter regions 30 of cabin roof 12 by clips 29. By providing alternative selectable slots or holes, the engagements between legs 26 and bars 14, 15 and between legs 26 and feet 28 are respectively adjustable longitudinally of the respective carry bar and vertically with respect to the cabin roof. The support frame is thus highly flexible and may be employed on a wide range of vehicles.

Figure 3:
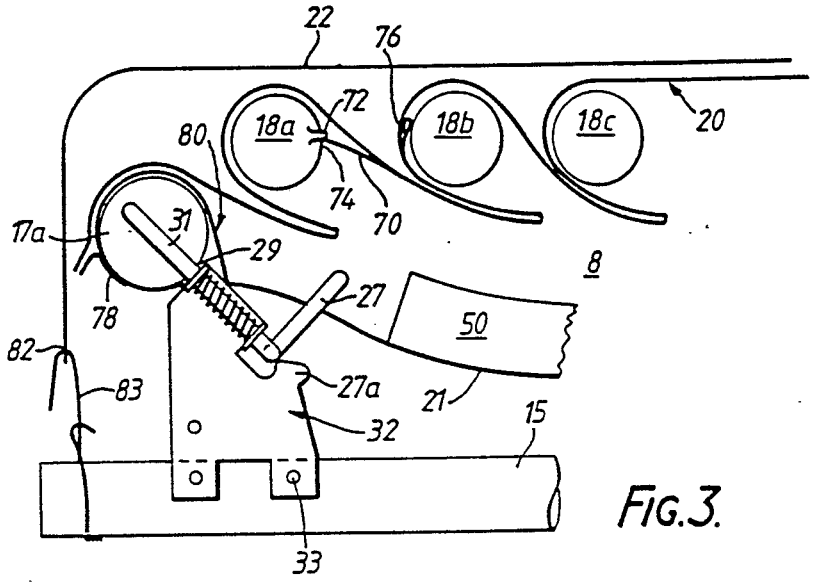
FIG. 3 is an enlargement of part of FIG. 2.
Figure 4:
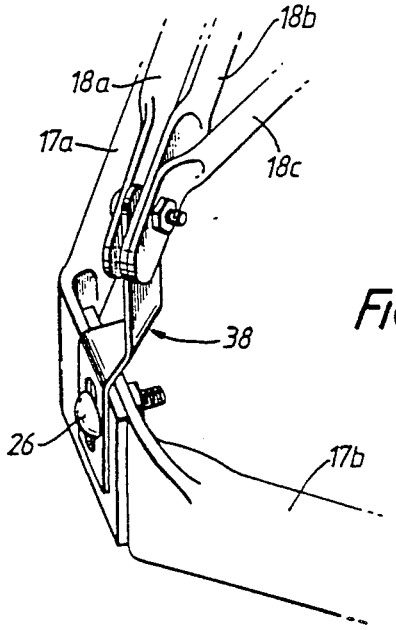
FIG. 4 is a perspective detail of one of the corner points at which the canopy ribs and peripheral bed base members are assembled.
Figure 5:
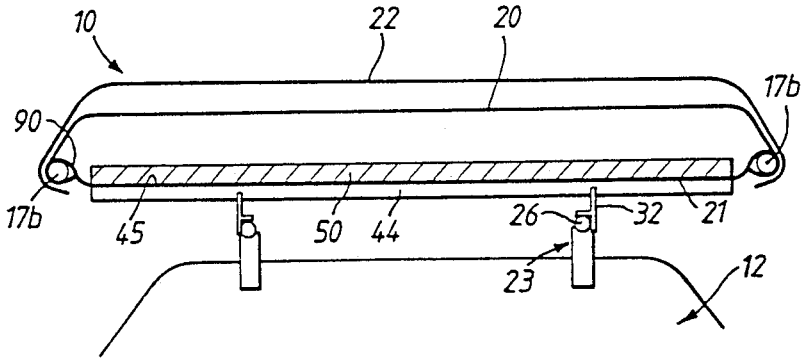
FIG. 5 is a cross-section on the line 5—5 in FIG. 2.

Each carry bar of the roof support frame also has, adjacent to each of its ends, respective upstanding brackets 32 which may be attached to the bars by rivets 33 or otherwise (FIG. 3). Brackets 32 are, at their upper ends, releasably securable to lateral bed base tubes 17*a* by means of retractable spring-loaded inclined plungers 31 which engage apertures 29 in the respective tubes. The plunger is L-shaped to provide a laterally projecting grip 27 for retracting the plunger from aperture 29. The retracted condition can be maintained by rotating the plunger to locate the grip 27 behind a stop 27*a* on the bracket. Bed base tubes 17*a*, 17*b* are flattened and bent at their ends and thereby overlapped and fastened together by corner bolts 36 (FIG. 4) to complete a rectangular bed base 17 peripherally about a sleeping zone 8.

The plane of the bed base 17 is typically about 80 mm above the plane of carry bars 14, 15. Elongate support 44, typically a further tube of similar diameter to tubes 17*a*, is affixed to carry bars 14, 15 by upstanding brackets 46 (FIG. 2) laterally centrally, of and with its uppermost face 45 immediately below the lowermost plane of, lateral bed base tubes 17*a*, i.e. the plane tangential to the undersides of the two tubes. Brackets 46 are affixed atop the carry bars by rivets or other suitable means. Support tube 44 may be restrained by front and rear bed base tubes 17*b* instead of or as well as being attached to support brackets 46, but more preferably overlaps the carry bars and stops short of the front and rear bed base tubes by say 70 to 80 mm.

Figure 2:
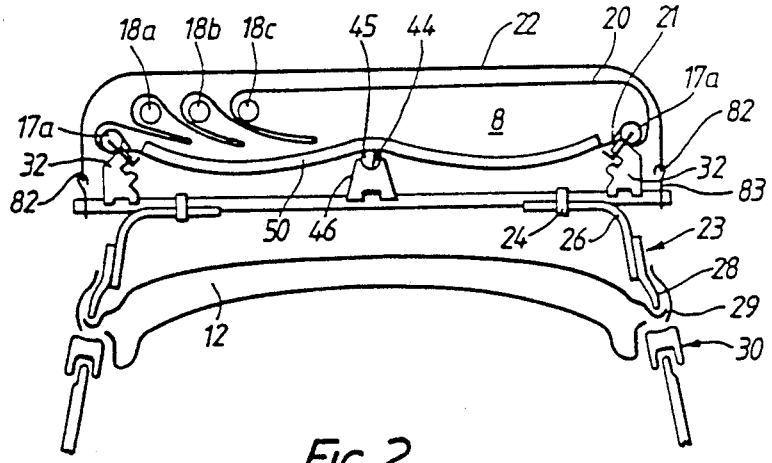
FIG. 2 is a transverse cross-section of the camper unit of FIG. 1, viewed from near one end of the camper unit towards the other end, and shown atop a vehicle cabin roof.

Bed base sheet 21 is folded over and secured along its edge to define tubular pockets 80 which receive the respective bed base tubes, as best seen in FIG. 2. A mattress 50 is optionally provided on sheet 21.

The camper canopy ribs 18*a*, 18*b* and 18*c* are conventional U-shaped ribs familiar in units of this kind but preferably are each constructed of interengageable sub ribs. This facilitates compactness of packaging in a customer-assembly camper kit. The canopy ribs are commonly and pivotably mounted to upstanding twisted brackets 38 (FIG. 4) on one side of the camper at both ends of one bed base tube 17*a*. Brackets 38 are secured by the aforementioned bolts 36 which assemble the bed base tubes together.

The camper canopy 20 is formed of multiple webs stitched together, and is secured to ribs 18 by plural ties 70, typically two per rib, one of which is shown in FIG. 3. Each tie 70 is sewn or otherwise fastened at one end to the underside of the canopy and at the other end carries a resiliently compressible U-shaped clip 72 which snap engages a complementary aperture 74 in the rib. Clip 72 may be released by simply squeezing its legs together so that the fine outurned feet at their free ends can clear the rim of the aperture. FIG. 3 also shows a typical seam 76 between component webs of the canopy.

Canopy 20 is supported from bed base tubes 17 by being stitched to an intermediate piece of material 78 (FIG. 3) which has been itself stitched to the pockets 80 of sheet 21 embracing the tubes.

Sufficient slack is built into the canopy 20 so that the rib assembly may be expanded by pivoting ribs 18*a*, 18*b*, 18*c* from a compact collapsed condition (FIG. 2) to an expanded condition such as that shown in FIG. 1 in which the ribs brace a tautened canopy. One or more of the ribs may be telescopically extensible if desired. The expanded condition may be maintained by securing one or more cords 84 to a hook or other suitable feature on the car body.

The portion of the canopy to the same side of the unit as pivot brackets 38 will typically be provided between rib 18*c* and the bed base with a door opening 20*a* for persons to climb and enter through. This aperture may be selectively closable by an insect screen flap and/or by a solid storm cover, utilizing zip (sliding clasp) fasteners.

The portion of the canopy on the opposite side of the unit, between rib 18*a* and the bed base, will typically be provided with ventilating insect screen sections 20*b* or other features as desired.

Travel cover 22 has spaced eyes (indicated schematically at 82) by which it may be fastened by respective cords 83 to the outer ends of carry bars 14, 15. Further cords may be tied between other eyes and passed under the corners of the bed base. A ladder (not shown) may also be stored under the cover and hooked in use over a rail secured between the brackets 32 near door opening 20*a*.

The bed base sheet 21 comprises a strong flexible non-stretch material mounted on the bed base tubes 17, especially the lateral tubes 17*a*, to be sufficiently relaxed so that, whether carrying one or two sleepers in sleeping zone 8, the sheet sags to contact elongate support tube 44 and comfortably cradles the respective sleepers to opposite sides of this support tube. Moveover, the minimum clearance between the sheet 21 and the underlying carry bars 14, 15 is 15 mm when either one or two sleepers are in a relaxed horizontal mode in the sheet. Thus, the sleepers feel secure and confident, even when the vehicle is not on exactly level ground, are in no danger of rolling out, and do not tend to roll together.

A convenient customer assembly kit of the illustrated camper unit might typically include, as separate components, the carry bars 14, 15, with attached brackets 32, 46, their bracket assemblies 23, sheet 21 with canopy 20, ribs 18, bed base tubes 17, support tube 44, cover 22 and mattress 50. The customer would mount the carry bars and support tube 44, insert the tubes 17 through the sheet pockets 80, bolt them together with brackets 38, mount the ribs and attach the canopy 20.

I claim:

1. A camper unit for vehicle cabin roofs, comprising:

a support frame adapted to be secured to the cabin roof of a vehicle;

plural elongate members arranged together to define a bed base peripherally about a sleeping zone;

means for detachably securing said bed base to the support frame;

a canopy assembly mounted to said bed base and adjustable between a compact collapsed condition and an expanded erect condition;

an elongate support extending centrally of the bed base and having an uppermost face just below the level of the bed base; and bed base sheet means secured to the bed base and being such that, when loaded with two sleepers in said sleeping zone, said bed base sheet means sags sufficiently to contact said elongate support and to comfortably cradle the respective sleepers to opposite sides of said elongate support.

2. A camper unit according to claim 1 wherein said support frame comprises a pair of carry bars and means is provided to mount said elongate support across and above the carry bars.

3. A camper unit according to claim 1 wherein the bed base is generally rectangular and includes lateral and front and rear elongate bed base members, and said uppermost face of the elongate support is positioned substantially immediately below the lowermost plane of the lateral bed base members.

4. A camper unit according to claim 1, wherein the maximum cradling sag of the bed base sheet to each side of said elongate support is such that the sheet does not contact the support frame when either one or two sleepers are in a relaxed horizontal mode on the sheet.

5. A camper unit according to claim 4 wherein the minimum clearance between the sheet and the support frame is 15 mm when either one or two sleepers are in a relaxed horizontal mode on the sheet.

6. A camper unit according to claim 1 wherein said canopy assembly comprises a plurality of hingedly mounted U-shaped ribs, and a canopy attached to the ribs and to said bed base.

7. A camper unit according to claim 6 wherein the canopy is attached to each of said ribs by plural ties each having a clip which releasably snap engages a complementary aperture in the rib.

8. A camper unit according to claim 1 wherein said support frame comprises a pair of carry bars and respective bracket assemblies for securing each of said bars to the gutter of a vehicle cabin roof, each of which bracket assemblies is adjustable both longitudually of the respective carry bar and vertically with respect to the cabin roof.

9. A camper unit according to claim 1 further comprising a travel cover having means for securing the cover to the support frame and under the corners of the bed base.

10. A camper unit according to claim 1 further comprising a mattress resting on said bed base sheet.

11. A camper unit for vehicle cabin roofs, comprising:

a support frame adapted to be secured to the cabin roof of a vehicle;

plural elongate members arranged together to define a bed base peripherally about a sleeping zone;

means for detachably securing said bed base to the support frame;

a canopy assembly mounted to said bed base and adjustable between a compact collapsed condition and an expanded erect condition;

an elongate support extending centrally of the bed base and mounted to said support frame; and bed base sheet means secured to the bed base and being such that, when loaded with two sleepers in said sleeping zone, said bed base sheet means contacts said elongate support and sags to comfortably cradle the respective sleepers to opposite sides of said elongate support.

12. A kit for a camper unit comprising:

a first set of components adapted to be secured to the cabin roof of a vehicle and thereon define a support frame;

a second set of components and fixings co-operable when assembled to define a bed base laterally about a sleeping zone;

means for detachably securing said bed base to said support frame;

a third set of components co-operable to form a canopy assembly adapted for mounting to said bed base;

an elongate member adapted to extend centrally of the bed base with an uppermost face just below the level of the bed base; and bed base sheet means securable to the bed base and being such that, when loaded with two sleepers in said sleeping zone, said bed base sheet means sags sufficiently to contact said elongate support and to comfortably cradle the respective sleepers to opposite sides of said elongate support.

* * * * *